US008894306B2

(12) United States Patent
Kosuge

(10) Patent No.: US 8,894,306 B2
(45) Date of Patent: Nov. 25, 2014

(54) HALF-CUT DEVICE, TAPE PRINTER INCLUDING THE SAME, AND CONTROL METHOD FOR STEPPING MOTOR

(75) Inventor: Shinsaku Kosuge, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 45 days.

(21) Appl. No.: 13/609,583

(22) Filed: Sep. 11, 2012

(65) Prior Publication Data

US 2013/0064593 A1 Mar. 14, 2013

(30) Foreign Application Priority Data

Sep. 12, 2011 (JP) ..... 2011-197986

(51) Int. Cl.

| | |
|---|---|
| ***B41J 11/70*** | (2006.01) |
| ***B26D 5/08*** | (2006.01) |
| ***B41J 11/66*** | (2006.01) |
| ***B26D 1/30*** | (2006.01) |
| ***B26D 3/08*** | (2006.01) |
| ***B26D 5/00*** | (2006.01) |

(52) U.S. Cl.

CPC ..... *B41J 11/703* (2013.01); *B41J 11/666* (2013.01); *B26D 1/305* (2013.01); *B26D 3/085* (2013.01); *B26D 5/00* (2013.01)

USPC ..... 400/621

(58) Field of Classification Search

USPC ..... 400/621

See application file for complete search history.

(56) References Cited

U.S. PATENT DOCUMENTS

| | | | | | |
|---|---|---|---|---|---|
| 5,223,940 | A * | 6/1993 | Matsumoto | ..... | 358/304 |
| 5,315,398 | A * | 5/1994 | Otsuki | ..... | 358/304 |
| 5,671,065 | A * | 9/1997 | Lee | ..... | 358/304 |
| 5,957,597 | A * | 9/1999 | Kato | ..... | 400/621 |
| 6,408,727 | B1 * | 6/2002 | Harris et al. | ..... | 83/566 |
| 2007/0068355 | A1 * | 3/2007 | Bascom et al. | ..... | 83/552 |
| 2011/0052301 | A1 * | 3/2011 | Crystal et al. | ..... | 400/621 |
| 2011/0280644 | A1 * | 11/2011 | Toyoshima | ..... | 400/621 |

FOREIGN PATENT DOCUMENTS

| | | | | | |
|---|---|---|---|---|---|
| JP | 03003797 | A * | 1/1991 | | |
| JP | 06008194 | A * | 1/1994 | ..... | B41J 11/70 |
| JP | 06286241 | A * | 10/1994 | ..... | B41J 11/66 |
| JP | 09011192 | A * | 1/1997 | ..... | B26D 5/08 |
| JP | 11010592 | A * | 1/1999 | ..... | B26D 5/28 |
| JP | 2002-103279 | A | 4/2002 | | |
| JP | 2002-254393 | A | 9/2002 | | |
| JP | 2006168094 | A * | 6/2006 | ..... | B41J 11/70 |
| JP | 2006297598 | A * | 11/2006 | | |
| JP | 3861558 | B | 12/2006 | | |
| JP | 4224719 | B | 2/2009 | | |
| JP | 4337937 | B | 9/2009 | | |
| JP | 4539620 | B | 9/2010 | | |

* cited by examiner

*Primary Examiner* — Nguyen Ha

(74) *Attorney, Agent, or Firm* — ALG Intellectual Property, LLC

(57) ABSTRACT

A half-cut device including: a half cutter for cutting a main tape or a released tape of a processed tape which the released tape is affixed to the main tape; a stepping motor for driving the half cutter to cut; and a motor control unit for controlling the stepping motor, wherein the motor control unit controls the stepping motor to maintain the condition which the half cutter cuts the main tape or the released tape for a predetermined time.

11 Claims, 9 Drawing Sheets

HALF-CUT DEVICE, TAPE PRINTER INCLUDING THE SAME, AND CONTROL METHOD FOR STEPPING MOTOR

CROSS-REFERENCE

The entire disclosure of Japanese Patent Application No. 2011-197986 filed on Sep. 12, 2011, which is hereby incorporated by reference in its entirety.

BACKGROUND

A cutting device for a processed tape known in the art includes a first cutting mechanism which has a full-cut function, a second cutting mechanism which has a half-cut function, a single cutter motor which provides driving power for these cutting mechanisms, and a driving mechanism which drives the first cutting mechanism and the second cutting mechanism by the driving power of the cutter motor (see Japanese Patent No. 4,539,620). The second cutting mechanism has a receiver and a movable cutter which moves close to and away from the receiver. According to this type of cutting device, the receiver abuts a pair of projections provided at both ends of the movable cutter to produce a clearance having a length equivalent to the thickness of a released tape between the receiver and the movable cutter. In this condition, the cutting device cuts only the main tape of the processed tape (half cutting).

At the time of half cutting, the actuation of the cutter motor for cutting is continued for a period longer by certain seconds than the time required for the abutment between the receiver and the projections of the movable cutter so as to perform secure cutting and thereby achieve desirable half cutting. In this case, a certain level or higher of torque is not applied to the cutter motor by the function of a torque limiter inserted into a transmission mechanism of the driving mechanism. This torque limiter has a pair of gears and a coil spring interposed between the gears.

According to the cutting device disclosed in Japanese Patent No. 4,539,620, the cutting force of a half cutter (second cutting mechanism) is controlled by using the torque limiter which chiefly utilizes the force of the coil spring. In this case, the cutting speed of the half cutter is variable due to the sliding load of the driving mechanism and the precision errors of the torque limiter. More specifically, the control value for the period of the half-cut operation is variable due to the instability of the time required for the abutment between the projections of the half cutter and the receiver. This condition prevents stabilization of the cutting period for the half cutting, and produces problems such as cutting of the main tape and insufficient cutting of the released tape.

SUMMARY

An advantage of some aspects of the invention is to provide a technology capable of solving at least a part of the aforementioned problems, and the invention can be implemented as the following modes or application examples.

Application Example 1

This application example is directed to a half-cut device which includes: a half cutter which cuts a main tape or a released tape of a processed tape which the released tape is affixed to the main tape; a stepping motor which drives the half cutter to cut; and a motor control unit which controls the stepping motor. The motor control unit controls the stepping motor to maintain the condition which the half cutter cuts the main tape or the released tape for a predetermined time.

According to this application example, the shift of the half cutter from the start of the cutting operation until the end of the cutting operation and the number of steps of the stepping motor required for the shift are accurately controlled. Thus, with continuation of the cutting operation, the half cutter collides with the processed tape and gradually raises the torque of the stepping motor. As a result, the stepping motor reaches the step-out condition, where the torque is stabilized at the step-out torque. In this case, the condition of the cut of the main tape or the released tape is maintained for the predetermined time.

Accordingly, the half-cut device of this application example can perform stable half cutting.

Application Example 2

It is preferable that, in the half-cut device of the above application example, the motor control unit controls the stepping motor to maintain the condition which the half cutter cuts the main tape or the released tape for n ($10 \leq n \leq 5{,}000$) steps of driving pulses applied to the stepping motor.

According to this application example, the stepping motor continues driving for n steps after the half cutter cuts the main tape or the released tape so as to maintain the condition after the cut of the main tape or the released tape by the half cutter. In this case, only the main tape or the released tape is securely cut, wherefore half cutting can be accurately carried out.

Accordingly, the half-cut device of this application example can perform stable half cutting.

Application Example 3

It is preferable that, in the half-cut device of the above application examples, the motor control unit controls the stepping motor to maintain the condition which the half cutter cuts the main tape or the released tape for t ($0.1 \leq t \leq 2$) second (s).

According to this application example, the stepping motor continues driving for t second(s) after the half cutter cuts the main tape or the released tape so as to maintain the condition after the cut of the main tape or the released tape by the half cutter. In this case, only the main tape or the released tape is securely cut, wherefore half cutting can be accurately carried out.

Accordingly, the half-cut device of this application example can perform stable half cutting.

Application Example 4

This application example is directed to a tape printer which includes: the half-cut device according to the above application examples; and a printing unit which performs printing for the processed tape fed to the half-cut device.

According to this application example, the processed tape after printing by the printing unit is fed to the half-cut device. In this case, only the main tape or the released tape is securely cut, wherefore half cutting can be accurately carried out.

Accordingly, the tape printer of this application example can accurately produce a label provided with a half-cut portion by a simplified structure.

Application Example 5

It is preferable that the tape printer of the above application example further includes a full cutter which cuts the main tape and the released tape, and a power transmitting unit which transmits either a normal rotation force or a reverse rotation force of the stepping motor to the half cutter, and transmits the other of the normal rotation force and the reverse rotation force to the full cutter.

According to this application example, the stepping motor is used as motors for both the full cutter and the half cutter. Thus, the entire structure of the device can be simplified. Moreover, since the cutting time control function provided by the stepping motor is also applied to the full cutter, the full cut operation can be accurately carried out by using the full cutter.

Accordingly, stable full cutting can be realized.

Application Example 6

This application example is directed to a control method for a stepping motor providing a power source for a half cutter cutting a main tape or a released tape of a processed tape which the released tape is affixed to the main tape. The control method includes controlling the stepping motor to maintain the condition which the half cutter cuts the main tape or the released tape for a predetermined time.

According to this application example, a motor control unit accurately controls the shift of the half cutter from the start of the cutting operation until the end of the cutting operation and the number of steps of the stepping motor required for the shift. Thus, with continuation of the cutting operation, the half cutter collides with the processed tape and gradually raises the torque of the stepping motor. As a result, the stepping motor reaches the step-out condition, where the torque is stabilized at the step-out torque. In this case, the condition of the cut of the main tape or the released tape is maintained for the predetermined time.

Accordingly, the half-cut device of this application example can perform stable half cutting.

BRIEF DESCRIPTION OF THE DRAWINGS

The invention will be described with reference to the accompanying drawings, wherein like reference numbers reference like elements.

DESCRIPTION OF EXEMPLARY EMBODIMENT

A half-cut device, a tape printer including this half-cut device, and a control method for a stepping motor according to an exemplary embodiment of the invention are hereinafter described with reference to the accompanying drawings.

In this embodiment, a tape printer having a half-cut function will be discussed as an example. This tape printer performs printing for a printing tape (processed tape) as a printing target while forwarding the tape, and cuts the printed portion of the printing tape while executing half cutting for the tape where appropriate so as to produce a label. In this embodiment, the directions toward the "front", "rear", "left", "right", "up", and "down" are defined as viewed from a user using the tape printer (as viewed from the front of the tape printer).

First Embodiment

Figure 1:
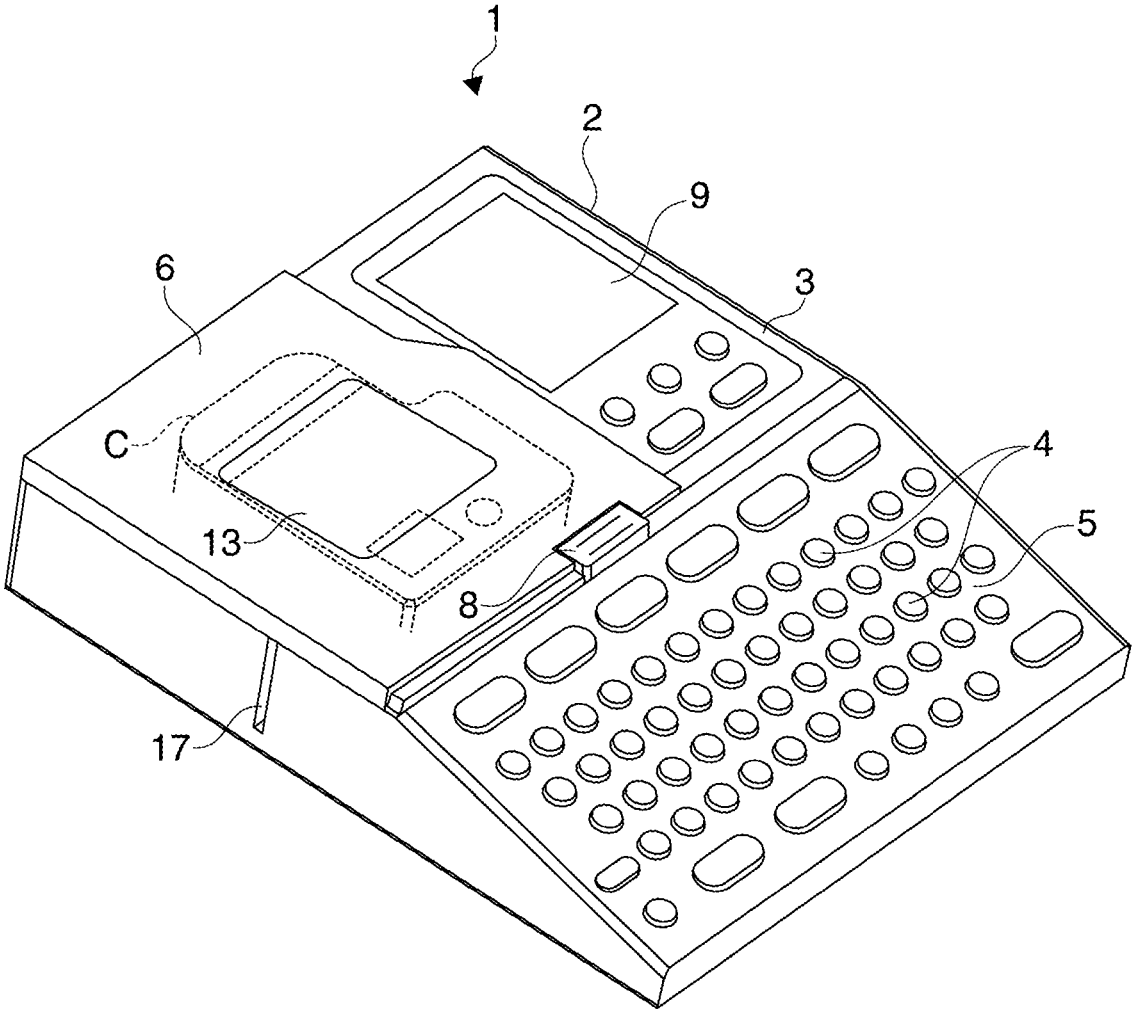
FIG. 1 is a perspective view illustrating the external appearance of a tape printer with its cover closed according to an embodiment.
Figure 2:
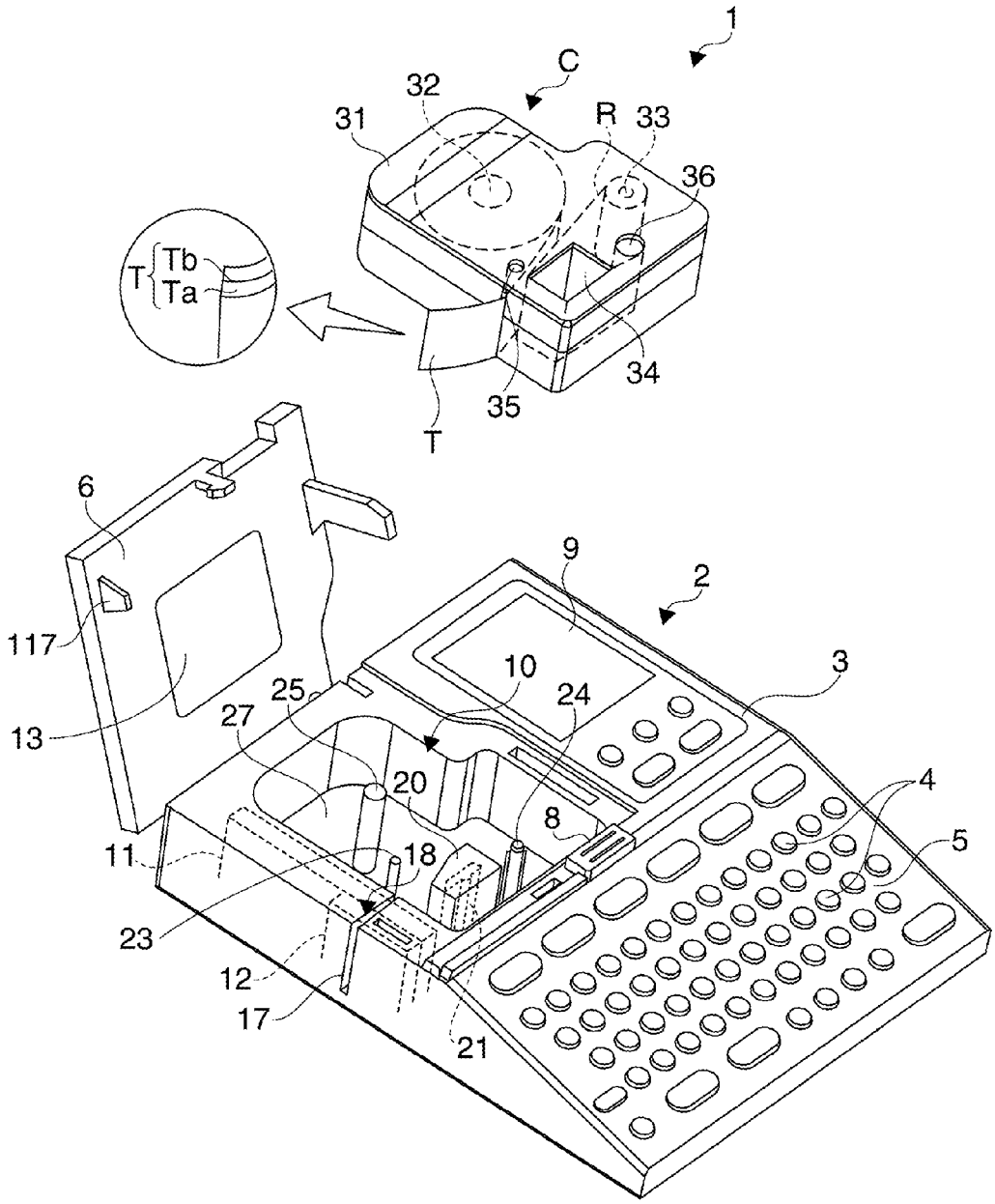
FIG. 2 is a perspective view illustrating the external appearance of the tape printer with its cover opened.

As illustrated in FIGS. 1 and 2, a tape printer 1 includes a device main body 2 which performs a printing process for a printing tape T, and a tape cartridge C containing the printing tape T and an ink ribbon R and detachably attached to the device main body 2. The printing tape T as a printing target is a tape to which a released tape Tb is attached, and is housed in the tape cartridge C in such a condition as to be freely drawn therefrom.

The external casing of the device main body 2 is constituted by a device case 3. A keyboard 5, which is a unit containing various types of keys 4, is disposed on the front half of the upper surface of the device case 3. On the other hand, an opening and closing cover 6 extends widely through the left part of the rear half of the upper surface of the device case 3. A cover open button 8 operated to open the opening and closing cover 6 is located before the opening and closing cover 6. A display 9 which notifies the input result received from the keyboard 5 is provided on the right part of rear half of the upper surface of the device case 3.

When the opening and closing cover 6 is opened by a press of the cover open button 8, a cartridge attachment portion 10 is exposed as an area concaved inside the opening and closing cover 6 to receive the tape cartridge C. The tape cartridge C is attached to or detached from the cartridge attachment portion 10 while the opening and closing cover 6 is open. The opening and closing cover 6 has a check window 13 through which the attachment or detachment of the tape cartridge C is visually checked even in the closed condition of the cartridge attachment portion 10 by closure of the opening and closing cover 6.

A tape outlet port 17 provided on the left side of the device case 3 communicates with the cartridge attachment portion 10. The area between the cartridge attachment portion 10 and the tape outlet port 17 corresponds to a tape outlet channel 18.

Assemblies of a tape cutting mechanism 11 and a tape discharge mechanism 12 are provided within the device case 3 in this order from the upstream side in such positions as to face to the tape outlet channel 18. The tape cutting mechanism 11 cuts the printing tape T, while the tape discharge mechanism 12 discharges a tape piece of the printing tape T after cutting to the outside via the tape outlet port 17.

Figure 4A:
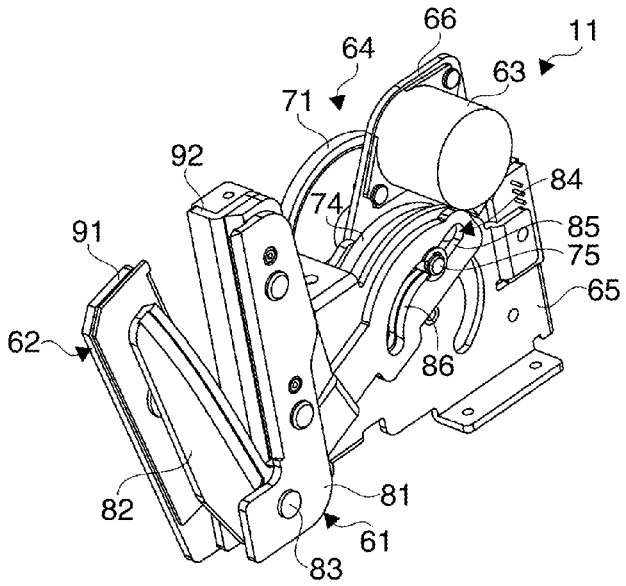
FIG. 4A is a perspective view of a tape cutting mechanism.
Figure 4B:
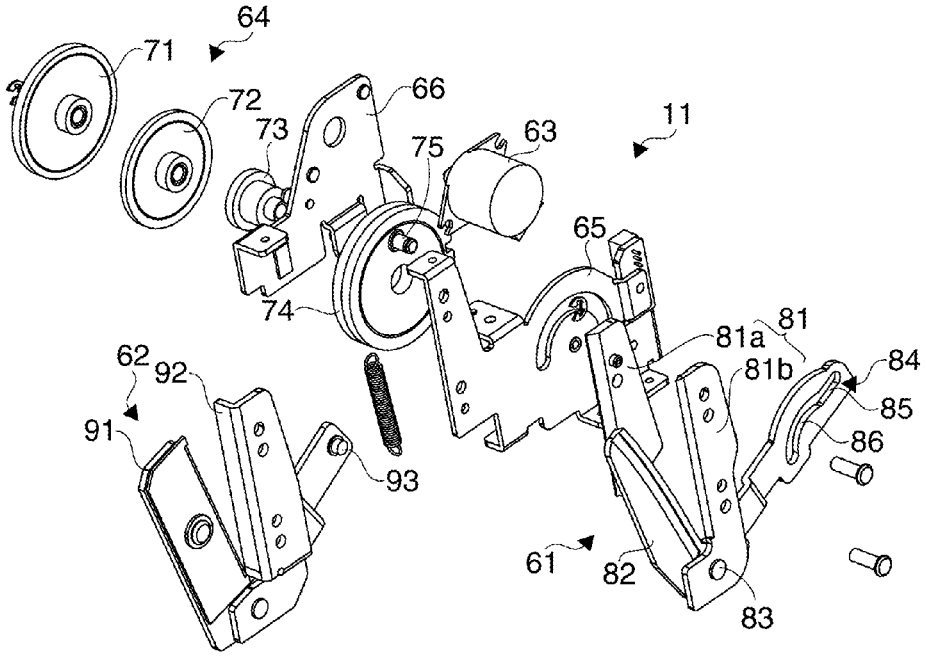
FIG. 4B is a perspective view illustrating the tape cutting mechanism in a disassembled condition.
Figure 5A:
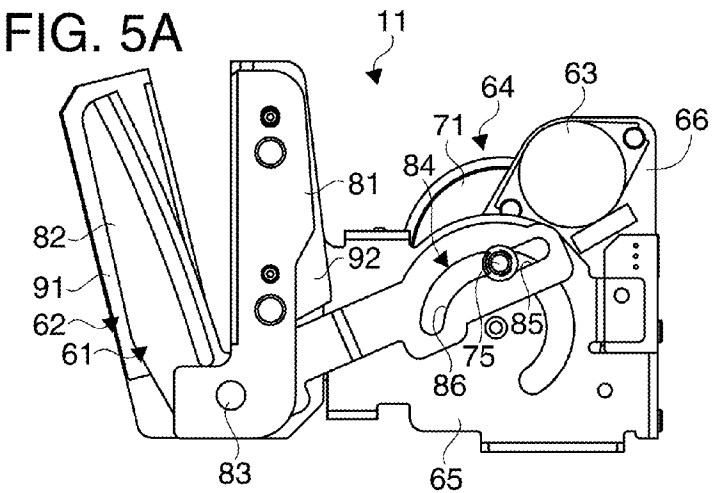
FIG. 5A is a right side view of the tape cutting mechanism.
Figure 5B:
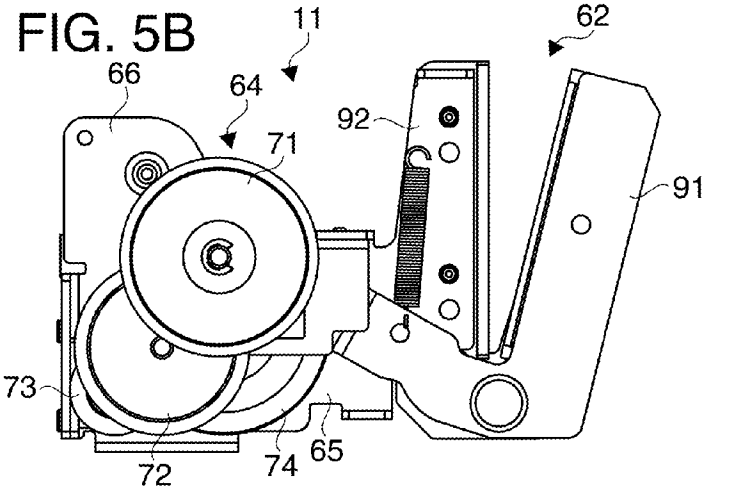
FIG. 5B is a left side view of the tape cutting mechanism.
Figure 5C:
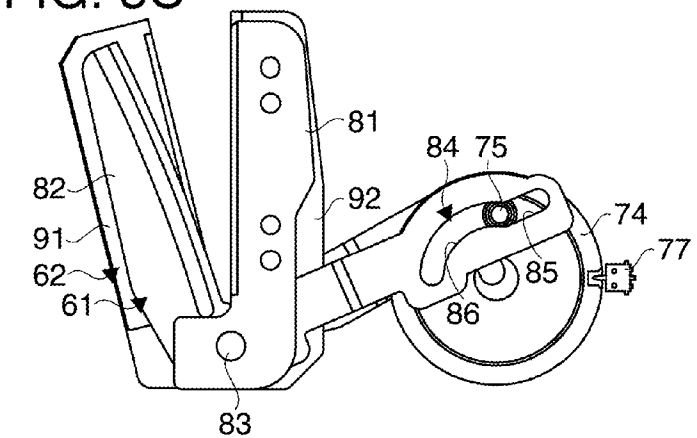
FIG. 5C is a right side view showing a crank disk and its surroundings.
Figure 5D:
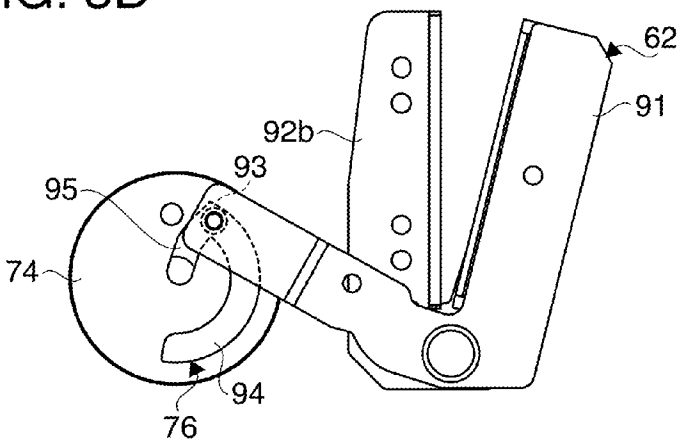
FIG. 5D is a left side view showing the crank disk and its surroundings.
Figure 6:
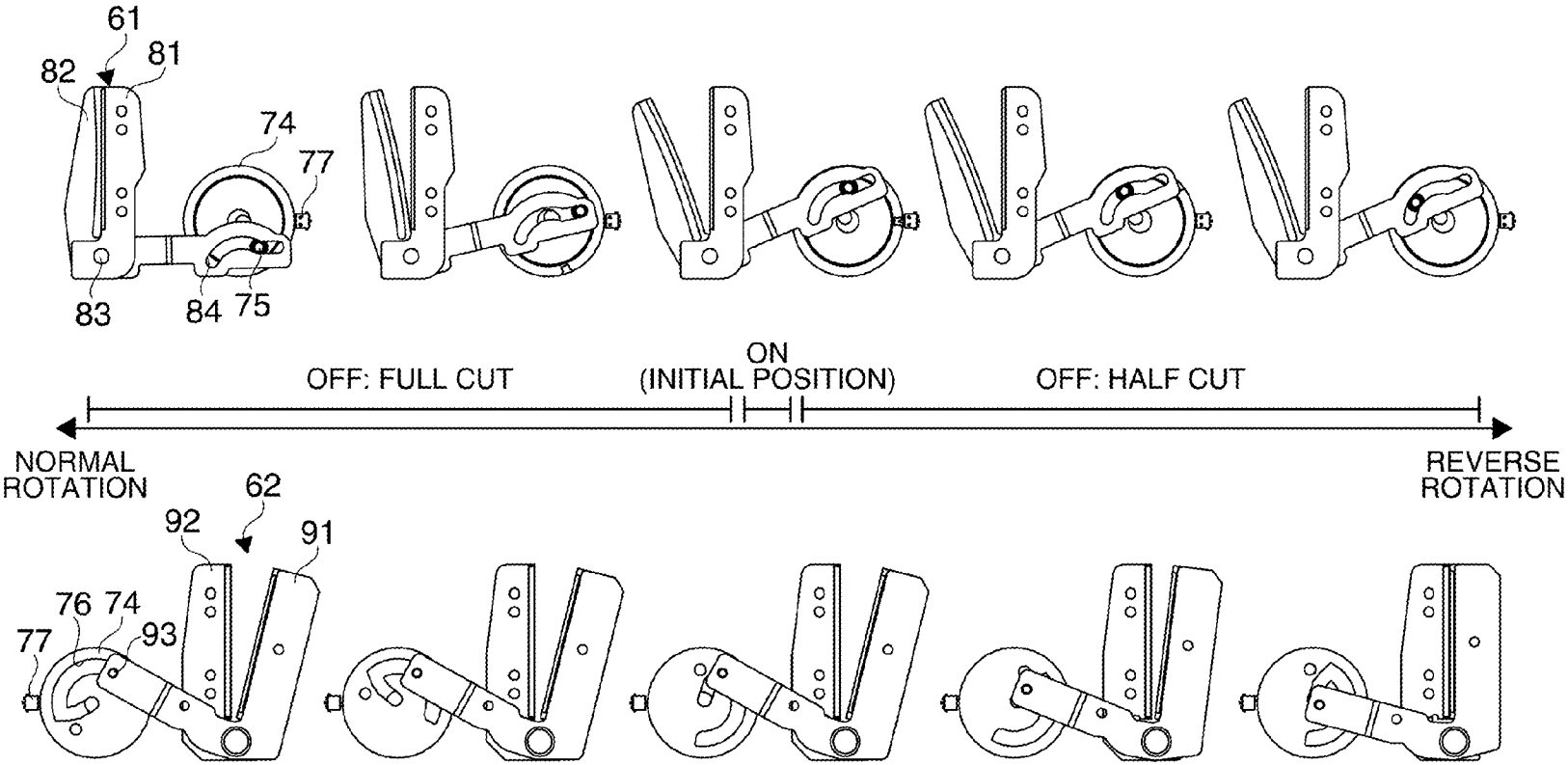
FIG. 6 illustrates actions of the crank disk rotating in the normal and reverse directions for full cutting and half cutting.

The tape cutting mechanism 11 has a full cutter 61 and a half cutter 62 shown in FIGS. 4A and 4B, and performs full cutting for cutting the whole of the printing tape T, and half cutting for cutting only a recording tape Ta (main tape). The details of the tape cutting mechanism 11 will be described later.

The cartridge attachment portion 10 is provided with a thermal type printing head 21 which has a plurality of heating elements within a head cover 20, a platen driving shaft 23 facing to the printing head 21, a winding driving shaft 24 which winds the ink ribbon R (described later), and a positioning projection 25 which positions a tape reel 32 (described later) of the tape cartridge C.

The platen driving shaft 23 and the winding driving shaft 24 penetrate a bottom plate 27 of the cartridge attachment portion 10. A tape feed power system 26 (see FIGS. 3A and 3B) as a power system for driving the platen driving shaft 23 and the winding driving shaft 24 is disposed within a space below the bottom plate 27.

The tape cartridge C contains the tape reel 32 around which the printing tape T is wound, and a ribbon reel 33 around which the ink ribbon R is wound. The tape reel 32 is disposed at the center of the rear part of the interior of a cartridge case 31, while the ribbon reel 33 is disposed in the right front part of the interior of the cartridge case 31. Both the reels 32 and 33 are equipped in such a condition as to freely rotate. The printing tape T and the ink ribbon R have the same width.

A through hole 34 formed on the left front side of the tape reel 32 is a hole through which the head cover 20 is inserted. A platen roller 35 which is rotatable by engagement with the platen driving shaft 23 is disposed in the vicinity of the through hole 34 in the area where the printing tape T and the ink ribbon R overlap with each other. A ribbon winding reel 36 which is rotatable by engagement with the winding driving shaft 24 is also disposed in the vicinity of the through hole 34 but at a position different from the position of the platen roller 35 and close to the ribbon reel 33.

When the tape cartridge C is attached to the cartridge attachment portion 10, respective engagements are achieved between the head cover 20 and the through hole 34, between the positioning projection 25 and the center hole of the tape reel 32, between the platen driving shaft 23 and the center hole of the platen roller 35, and between the winding driving shaft 24 and the center hole of the ribbon winding reel 36.

In accordance with rotations of the platen driving shaft 23 and the winding driving shaft 24, the printing tape T is drawn from the tape reel 32, while the ink ribbon R is drawn from the ribbon reel 33. The printing tape T and the ink ribbon R thus drawn out travel side by side along the through hole 34 while overlapping with each other. Then, the printing tape T is forwarded toward the outside of the cartridge case 31, while the ink ribbon R is wound around the ribbon winding reel 36. In the area where the printing tape T and the ink ribbon R travel side by side, the platen roller 35 and the printing head 21 face to the printing tape T and the ink ribbon R sandwiched between the platen roller 35 and the printing head 21, so as to perform so-called printing feed.

The printing tape T is constituted by the recording tape (main tape) Ta having an adhesive layer on its rear surface, and the released tape Tb affixed to the recording tape Ta via the adhesive layer. The printing tape T is wound around the tape reel 32 and contained in the tape cartridge C with the recording tape Ta positioned outside and the released tape Tb positioned inside.

The printing tape T is selected from a plurality of tape types having different tape widths, base colors of the printing tape T, base patterns, materials (feels of materials), for example, and contained in the cartridge case 31 together with the ink ribbon R.

The type of the printing tape T is determined by a plurality of tape identification sensors 37 (see FIG. 7) constituted by micro-switches or the like and disposed on the cartridge attachment portion 10 in correspondence with a plurality of holes (not shown) formed in the bottom surface of the cartridge case 31 for identification of the type of the printing tape T. The tape identification sensors 37 detect the conditions of the bit patterns of the plural holes to determine the tape type (particularly the tape width) of the printing tape T.

Upon closure of the opening and closing cover 6 after attachment of the tape cartridge C to the cartridge attachment portion 10, a not-shown head release mechanism initiates rotation of the printing head 21 to produce a printing standby condition of the tape printer 1 where the printing tape T and the ink ribbon R are sandwiched between the printing head 21 and the platen roller 35.

In response to an instruction for printing operation issued after the step of inputting and editing printing data, the platen roller 35 starts rotation to draw the printing tape T from the tape cartridge C, while the printing head 21 starts operation to perform desired printing for the printing tape T. During this printing operation, winding of the used ink ribbon R takes place within the tape cartridge C, while the printed portion of the printing tape T travels to the outside of the device through the tape outlet port 17.

At the end of the printing, the printing tape T and the ink ribbon R stop running after a sufficient feed of a margin portion. Then, the tape cutting mechanism 11 cuts the printed portion of the printing tape T by using the full cutter 61 while executing half cutting of the printing tape T where appropriate by using the half cutter 62.

As a result, the printing tape T is formed into a label (tape cut-piece) on which desired characters or the like are printed. The tape cut-piece thus produced is discharged from the tape outlet port 17 by the operation of the tape discharge mechanism 12.

The details of the tape feed power system 26, the tape cutting mechanism 11, and the tape discharge mechanism 12 are now explained with reference to FIGS. 3A through 6.

Figure 3A:
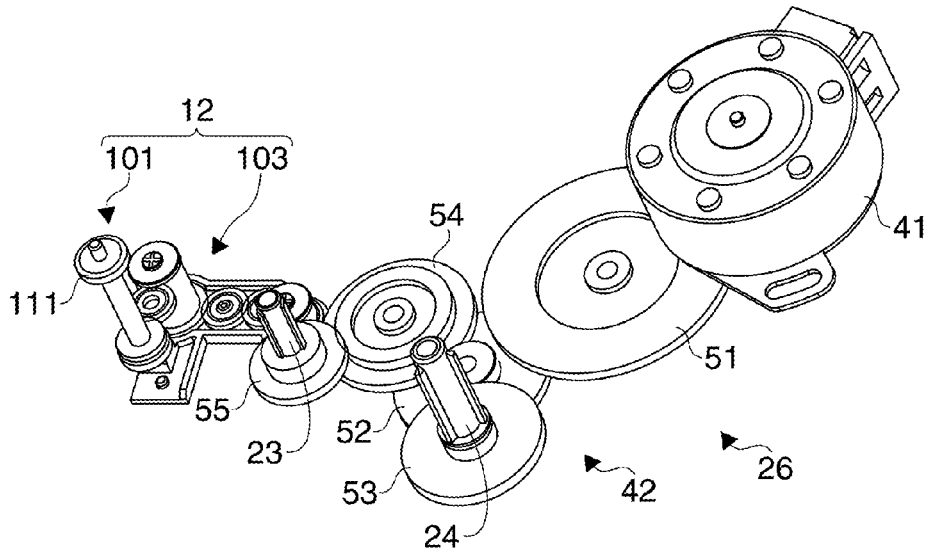
FIG. 3A is a perspective view of a tape feed power system.
Figure 3B:
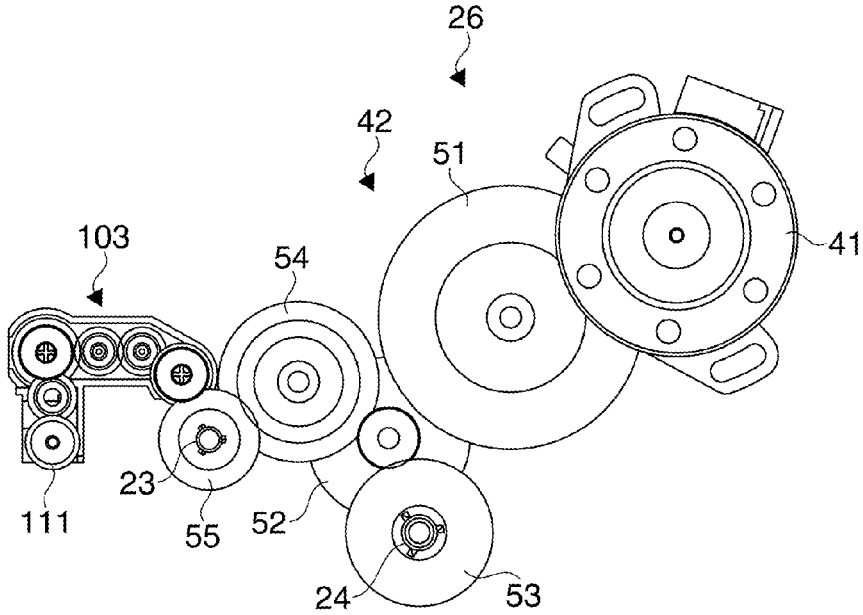
FIG. 3B is a plan view of the tape feed power system.

As illustrated in FIGS. 3A and 3B, the tape feed power system 26 includes a tape feed motor 41 as a power source, and a feed power transmitting mechanism 42 which transmits the power of the tape feed motor 41 to the platen driving shaft 23 and the winding driving shaft 24. Thus, the tape feed motor 41 functions as power sources for both the platen driving shaft 23 and the winding driving shaft 24. The tape feed motor 41 also functions as a power source for a discharge driving roller 111 of the tape discharge mechanism 12, the details of which will be described later.

The feed power transmitting mechanism 42 includes an input gear 51 which engages with a gear provided on the main shaft of the tape feed motor 41, a branching gear 52 which engages with the input gear 51 and branches the power into two parts for the platen driving shaft 23 and the winding driving shaft 24, a first output gear 53 which engages with the branching gear 52 and rotates the winding driving shaft 24 attached to the first output gear 53, a junction gear 54 which engages with the branching gear 52, and a second output gear 55 which engages with the junction gear 54 and rotates the platen driving shaft 23 attached to the second output gear 55.

Upon actuation of the tape feed motor 41, the platen driving shaft 23 and the winding driving shaft 24 connected to the tape feed motor 41 via the respective gears initiate rotations. These rotations forward the ink ribbon R in synchronization with the tape feed of the printing tape T.

The tape discharge mechanism 12 includes a driving roller unit 101 provided with the discharge driving roller 111, a discharge driven roller (not shown) facing to the discourage driving roller 111, and a discharge power transmission mechanism 103 which transmits the power of the tape feed motor 41 to the discharge driving roller 111.

As illustrated in FIGS. 4A through 5D, the tape cutting mechanism 11 includes the scissors-type full cutter 61 which performs full cutting of the printing tape T, the press-cut-type half cutter 62 which performs half cutting of the printing tape T, a cutter motor 63 functioning as a power source, a cutter power transmission mechanism (power transmitting unit) 64 which transmits the power of the cutter motor 63 to the full cutter 61 and the half cutter 62, and a cutter frame 65 and a gear frame 66 which support these components 61 through 64.

According to this structure, the cutter motor 63 functions as power sources for both the full cutter 61 and the half cutter 62. The "full cutting" in this context means a cutting process for cutting the whole of the printing tape T, i.e., both the recording tape Ta and the released tape Tb, while the "half cutting" means a cutting process for cutting only the recording tape Ta without cutting the released tape Tb.

The cutter motor 63 is a stepping motor which produces power for the cutting operations performed by the full cutter 61 and the half cutter 62. The full cutter 61 moves with the rotation of the cutter motor 63 whose rotation direction changes from normal to reverse when starting from the initial position, while the half cutter 62 moves with the rotation of the cutter motor 63 whose rotation direction changes from reverse to normal when starting from the initial position. The operation of half cutting utilizes the step-out phenomenon of the stepping motor for the control of the cutting torque applied to the printing tape T. Under the step-out condition of the stepping motor, burning of the coil is not caused unlike the case of a DC motor.

The cutter power transmission mechanism 64 includes a large first gear 71 engaging with an input gear attached to the cuter motor 63 (main shaft of the cutter motor 63), a second gear 72 engaging with the first gear 71, a small third gear 73 engaging with the second gear 72, and a crank disk 74 engaging with the third gear 73.

An eccentric crank pin 75 provided on the right end surface (full cutter 61 side) of the crank disk 74 engages with the root of a movable cutter 82 of the full cutter 61. On the other hand, a cam groove 76 formed in the left end surface (half cutter 62 side) of the crank disk 74 engages with the root of a cutter 91 of the half cutter 62.

The cutter power transmission mechanism 64 has a cutter position detection sensor 77 disposed in such a position as to face to a portion of the circumferential surface of the crank disk 74.

The cutter position detection sensor 77 determines whether the rotation position of the crank disk 74 is the initial position (ON), a position rotated in the normal direction from the initial position (OFF: full cut), or a position rotated in the reverse direction from the initial position (OFF: half cut) (see FIG. 6), and detects the position of the movable cutter 82 of the full cutter 61 and the position of the cutter 91 of the half cutter 62 (hereinafter referred to as cutter positions) based on the determination of the rotation position of the crank disk 74.

The full cutter 61 is a scissors-type cutter which has a fixed cutter 81 and the movable cutter 82 rotatably connected with each other via a support shaft 83.

Each of the fixed cutter 81 and the movable cutter 82 has an L shape. A long hole 84 formed in the root of the movable cutter 82 engages with the crank pin 75 of the crank disk 74 to convert the rotational movement of the crank pin 75 into a reciprocating cutting movement.

The fixed cutter 81 has a blade 81*a* and a blade holder 81*b* to which the blade 81*a* is attached. The support shaft 83 is fixed to the root of the blade holder 81*b*.

The long hole 84 of the full cutter 61 is so configured as to transmit (input) the normal rotation of the crank disk 74 to the full cutter 61, and not to transmit the reverse rotation of the crank disk 74 to the full cutter 61 (i.e., to allow idling of the full cutter 61), in cooperation with the crank pin 75.

More specifically, the long hole 84 is constituted by a combination of a linear hole portion 85 which is linear and associated with the normal rotation, and a circular-arc hole portion 86 which is circular-arc-shaped and associated with the reverse rotation. During normal rotation from the initial position, the crank pin 75 contacts the side surface of the linear hole portion 85 while shifting therealong, thereby giving a rotational load to the movable cutter 82 so that the movable cutter 82 can rotate. On the other hand, during reverse rotation from the initial position, the crank pin 75 shifts along the circular-arc hole portion 86, in which condition a rotational load is not given to the movable cutter 82 (see FIG. 6).

The half cutter 62 is a press-cut-type cutter which has the cutter 91 for cutting the printing tape T, and a cutter receiving member 92 for receiving the cutter 91 after cutting of the printing tape T.

The cutter 91 is rotatably attached to the cutter receiving member 92. During half cutting, the cutter 91 cuts the recording tape Ta by press cutting while contacting the entire area of the recording tape Ta. An engaging projection 93 which engages with the cam groove 76 of the crank disk 74 is provided at the root of the cutter 91.

The cam groove 76 of the crank disk 74 is so configured as not to transmit the normal rotation of the crank disk 74 to the half cutter 62 (i.e., to allow idling of the half cutter 62), and to transmit (input) the reverse rotation of the crank disk 74 to the half cutter 62, in cooperation with the engaging projection 93.

More specifically, the cam groove 76 is constituted by a combination of a circular-arc groove portion 94 which is a circular-arc-shaped groove extending along the circumference and associated with the normal rotation, and an inner groove portion 95 which extends from the circular-arc groove portion 94 toward the center. During normal rotation from the initial position, the engaging projection 93 makes relative movement along the circular-arc groove portion 94 without giving a rotational load to the cutter 91. On the other hand, during reverse rotation from the initial position, the engaging projection 93 contacts the side surface of the inner groove portion 95 while making relative movement therealong, and gives a rotational load to the cutter 91 so that the cutter 91 can rotate (see FIG. 6).

Accordingly, the cutter power transmission mechanism 64 is so structured as to transmit the rotational force of the normal rotation of the cutter motor 63 from the initial position to the full cutter 61, and transmit the rotational force of the reverse rotation of the cutter motor 63 to the half cutter 62.

Figure 7:
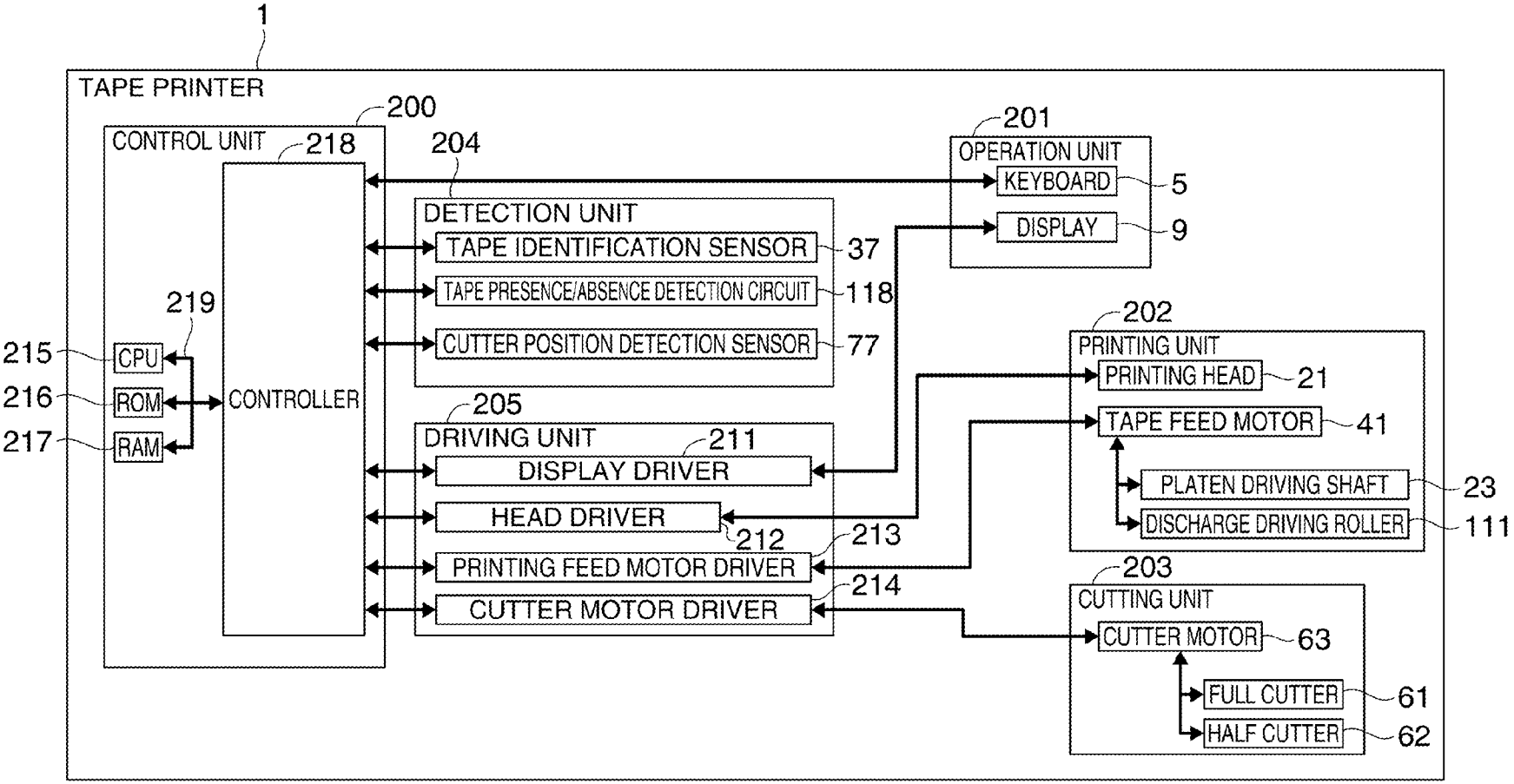
FIG. 7 is a control block diagram of the tape printer.

The control system of the tape printer 1 is now explained with reference to FIG. 7.

The tape printer 1 includes: an operation unit 201 which has the keyboard 5 and the display 9; a printing unit 202 which has the tape feed motor 41 for rotating the platen driving shaft 23 and the discharge driving roller 111, and the printing head 21; a cutting unit (half-cut device) 203 which has the cutter motor 63 for driving the full cutter 61 and the half cutter 62; and a detection unit 204 which has the tape identification sensors 37, a tape presence/absence detection circuit 118, and the cutter position detection sensor 77.

The tape printer 1 further includes a driving unit 205 which has a display driver 211 for driving the display 9, a head driver 212 for driving the printing head 21, a printing feed motor driver 213 for driving the tape feed motor 41, and a cutter motor driver 214 for driving the cutter motor 63. The tape printer 1 has a control unit (motor control unit) 200 connected with the respective units 211 through 205 and functioning as a controller for the overall operation of the tape printer 1.

The operation unit 201, which functions as an interface with a user, allows input of character information from the keyboard 5, and notification of various information shown on the display 9, and other functions.

The printing unit 202 drives the tape feed motor 41 to forward the printing tape T by rotation of the platen driving shaft 23, and drives the printing head 21 in accordance with the inputted character information to perform printing for the forwarded printing tape T. The printing unit 202 also drives the tape feed motor 41 to discharge the printing tape T by rotation of the discharge driving roller 111.

The cutting unit 203 drives the cutter motor 63 to allow the full cutter 61 and the half cutter 62 to perform half cutting and full cutting for the printing tape T after printing.

The detection unit 204 detects the tape type (particularly the tape width), the cutter positions, and the presence or absence of the printing tape T, and outputs the respective detection results to the control unit 200.

The control unit 200 contains a CPU 215, a ROM 216, a RAM 217, and a controller (IOC: input output controller) 218, all of which components 215 through 218 are connected with each other via an internal bus 219. The CPU 215 receives various types of signals and data from the respective units within the tape printer 1 via the controller 218 under a control program contained in the ROM 216. The CPU 215 processes various data within the RAM 217 based on the received various signals and data, and outputs various signal data to the respective units within the tape printer 1 via the controller 218.

The control unit 200 having this structure controls the printing process and the cutting process based on the detection results received from the detection unit 204, for example.

Figure 8:
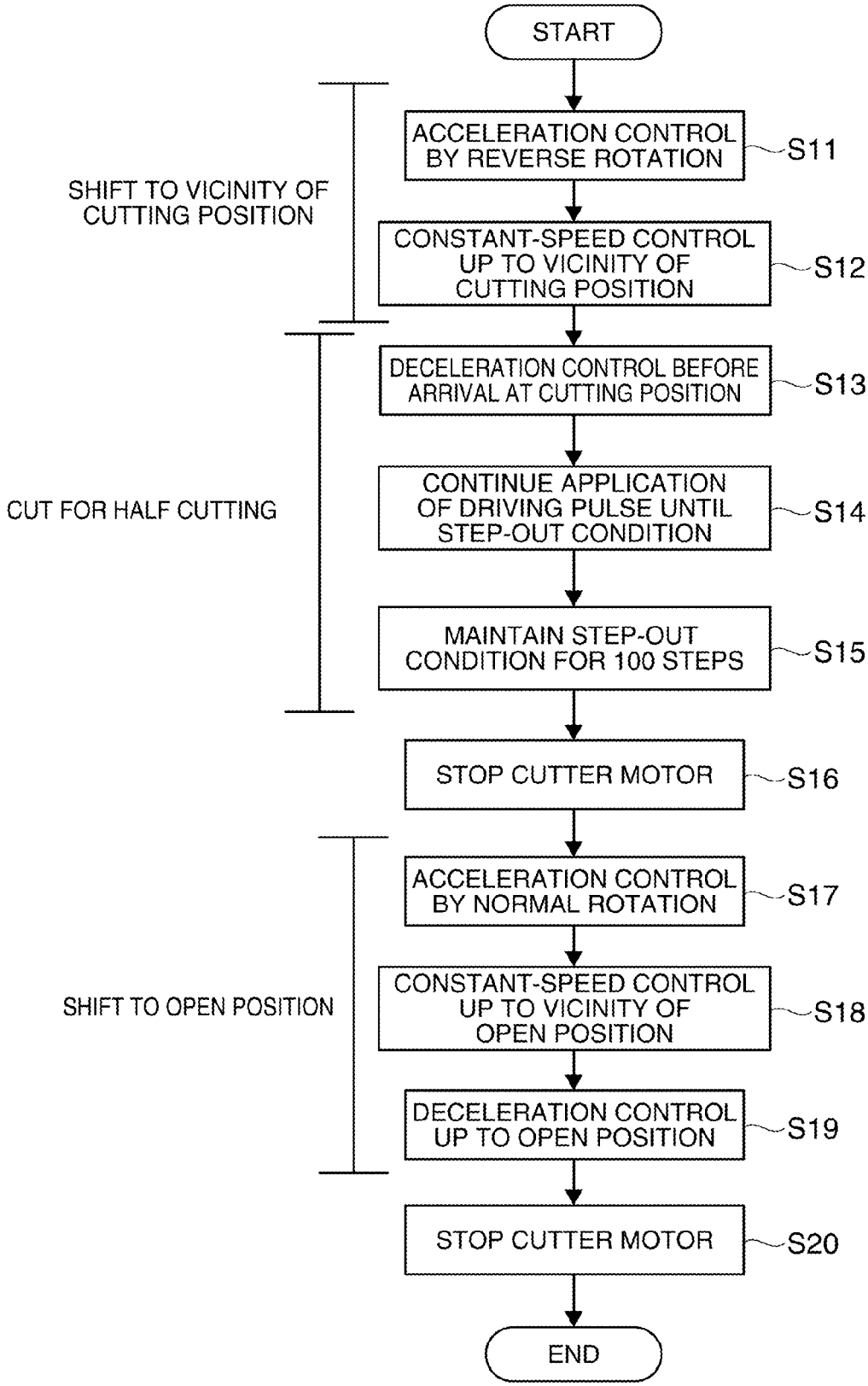
FIG. 8 is a flowchart showing a half cutting operation.
Figure 9A:
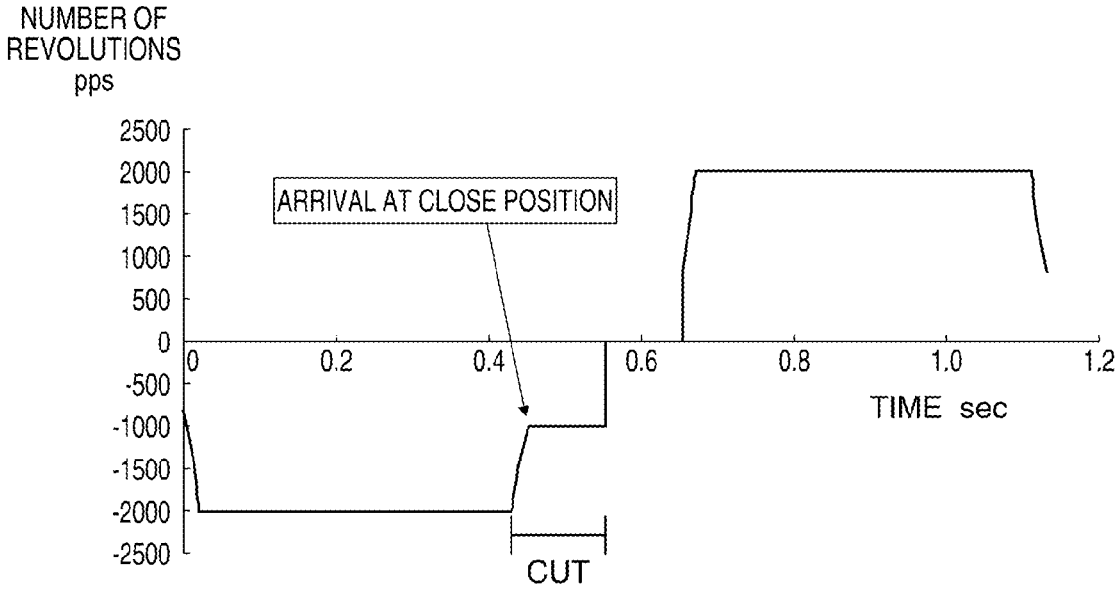
FIG. 9A shows operation sequences of the half cutting operation for a printing tape having a tape width of 24 mm.
Figure 9B:
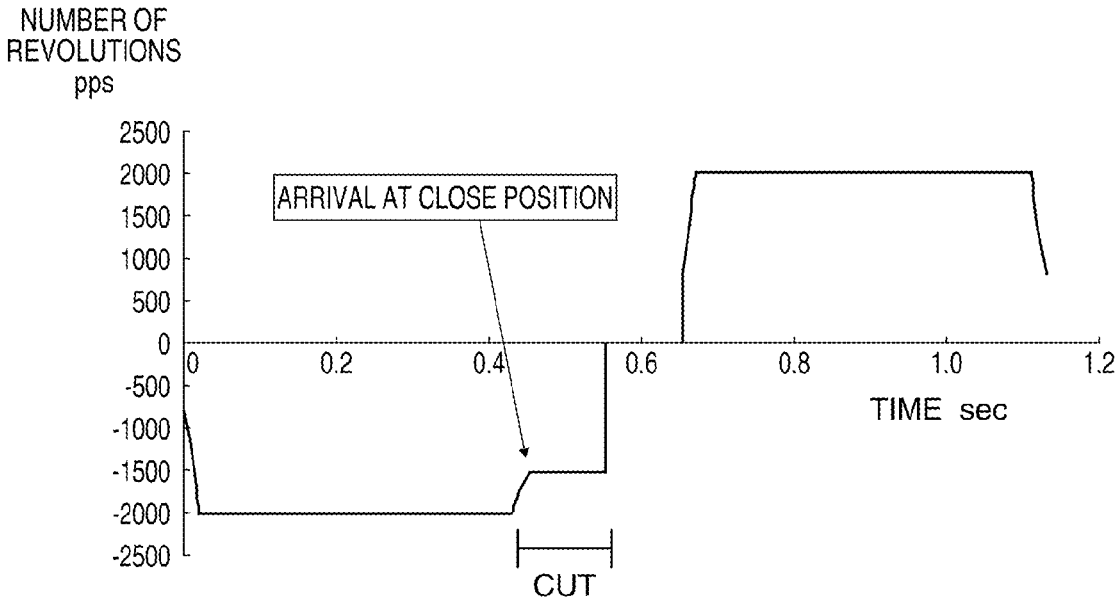
FIG. 9B shows operation sequences of the half cutting operation for a printing tape having a tape width of 12 mm.

The details of the half cut operation are now explained with reference to FIGS. 8 and 9A and 9B. FIG. 8 is a flowchart showing the half cut operation. FIGS. 9A and 9B illustrate operation sequences of the half cut operation. It is assumed that the control unit 200 stores the data on the tape width of the printing tape T detected by the detection unit 204 prior to the half cut operation. It is also assumed that the cutter position detection sensor 77 detects the cutter position to determine whether the cutter positions are in the abnormal condition or not. Hereinafter, the position corresponding to the full open condition of the movable cutter 91 is referred to as an open position, while the position corresponding to the full close position of the movable cutter 91 is referred to as a close position. In addition, the position corresponding to the contact condition between the cutter 91 and the surface of the recording tape Ta is referred to as a cutting position.

As can be seen from FIGS. 8 and 9A and 9B, upon the start of the half cut operation, the cutter 91 initially shifts from the open position to the vicinity of the cutting position. More specifically, the control unit 200 applies driving pulses for the reverse rotation driving to the cutter motor 63 to provide acceleration control up to a predetermined number of revolutions for shift (for example, 2,000 pps) (S11). Then, the control unit 200 provides constant-speed control while keeping this number of revolutions until the cutter 91 reaches the vicinity of the cutting position. In this case, the control unit 200 continues the number of steps and the constant-speed control for the shift toward the vicinity of the cutting position (S12).

When the cutter 91 reaches the vicinity of the cutting position, the flow goes to the half cutting process. The half cutting process is achieved by continuation of the cutting operation until the cutter motor 63 constituted by a stepping motor comes into the step-out condition (until step out) while controlling the step-out torque through modulation of the cycle of the driving pulses.

More specifically, with continuation of the cutting operation, the cutter 91 collides with the printing tape T (recording tape Ta), and gradually raises the torque of the cutter motor 63. As a result, the torque of the cutter motor 63 reaches the step-out torque, and the cutter motor 63 comes into the step-out condition. Under the step-out condition of the cutter motor 63, the torque does not rise any more. Thus, the torque is stabilized at the step-out torque as long as the cutting operation is continued. The step-out torque can be controlled by adjustment of the cycle of the driving pulses of the cutter motor 63.

In other words, the torque of the cutter motor 63 is adjusted to a predetermined step-out torque by continuation of the cutting operation until the cutter motor 63 employed in this embodiment comes into the step-out condition. Accordingly, the torque corresponding to the cutting force can be adjusted to a predetermined value only by the control of the stepping motor (cutter motor 63).

More specifically, the cycle of the driving pulses is modulated to decrease the speed of the cutter motor 63 so that the number of revolutions becomes a desired value before arrival of the cutter 91 at the cutting position (S13).

The desired number of revolutions corresponds to the cutting load necessary for the cutting operation of the half cutter 62, and is determined in accordance with the tape width detected by the detection unit 204. Since the cutting force (cutting load) required for half cutting is variable according to the tape width of the printing tape T, the cycle of the driving pulses is modulated into a cycle sufficient for producing the step-out torque corresponding to the necessary cutting force for the tape width so as to obtain the desired number of revolutions for the cutting force.

For example, when the tape width is 24 mm (see FIG. 9A), the cycle of the driving pulses is modulated such that the number of revolutions becomes 1,000 pps. When the tape width is 12 mm (see FIG. 9B), the cycle of the driving pulses is modulated such that the number of revolutions becomes 1,500 pps.

When the cutter 91 reaches the cutting position, the driving pulses are kept applied to continue the cutting operation until the cutter motor 63 comes into the step-out condition (S14). This step-out condition is maintained for 100 steps of the driving pulses (S15).

Under this condition, half cutting of the printing tape T takes place, and the half cutting process ends.

Upon completion of the half cutting process, the actuation of the cutter motor 63 stops (S16). After an elapse of a fixed time (such as 0.1 second), the cutter 91 shifts from the close position (where only the recording tape Ta is cut) to the open position.

More specifically, the driving pulses for the normal rotation driving are applied to the cutter motor 63 to increase the speed of the cutter motor 63 up to a predetermined number of revolutions for shift (such as 2,000 pps) (S17). Then, the constant speed is maintained at this number of revolutions until the cutter 91 reaches the vicinity of the open position (S18). After continuation of the constant speed control for the number of steps for the shift to the vicinity of the open position, the speed of the cutter motor 63 is decreased until arrival at the open position (S19). When the cutter 91 reaches the open position, the actuation of the cutter motor 63 stops (S20) to end the half cutting operation.

According to this structure, the number of steps corresponding to the cutting time can be adjusted to a predetermined value only by the control of the cutter motor 63. Thus, the cutting time of the half cutter 62 can be accurately controlled by a simple mechanism.

Moreover, actuation of the cutter motor 63 is continued for 100 steps after the step out of the cutter motor so that the step-out condition can be maintained. Accordingly, the recording tape Ta or the released tape Tb can be securely cut, wherefore desirable half cutting can be achieved.

Furthermore, the cutter motor 63 (stepping motor) is used as motors for both the full cutter 61 and the half cutter 62 by the function of the cutter power transmission mechanism 64. Thus, the entire structure of the device can be simplified. Moreover, since the torque control function provided by the stepping motor is also applied to the full cutter 61, the full cut operation can be accurately carried out by using the full cutter 61.

According to this embodiment, the step-out condition is maintained for 100 steps of the driving pulses applied to the cutter motor 63. However, the number of steps is not limited to this number but may be n ($10 \leq n \leq 5{,}000$) number of steps. Alternatively, such a structure which maintains the step-out condition for t ($0.1 \leq t \leq 2$) on the basis of time period instead of the number of steps may be adopted.

According to this embodiment, the half cutting operation is performed under the torque control utilizing the step-out torque. However, the full cutting operation may also be executed under similar torque control.

According to this embodiment, only the recording tape Ta is cut in the process of half cutting. However, only the released tape Tb may be cut in half cutting.

What is claimed is:

1. A half-cut device comprising:

a half cutter for cutting a main tape or a released tape of a processed tape which the released tape is affixed to the main tape;

a stepping motor for driving the half cutter to cut; and a motor control unit for controlling the stepping motor, wherein the motor control unit controls the stepping motor to cause the half cutter to contact the processed tape and then increases a cutting torque of the stepping motor until the cutting torque is stabilized at a step-out torque for the stepping motor, and wherein the step-out torque at which the half cutter cuts the main tape or the released tape is maintained for a predetermined time.

2. The half-cut device according to claim 1, wherein the motor control unit controls the stepping motor to maintain the step-out torque at which the half cutter cuts the main tape or the released tape for n ($10 \leq n \leq 5{,}000$) steps of driving pulses applied to the stepping motor.

3. The half-cut device according to claim 1, wherein the motor control unit controls the stepping motor to maintain the step-out torque at which the half cutter cuts the main tape or the released tape for t ($0.1 \leq t \leq 2$) second(s).

4. The half-cut device according to claim 1, wherein the motor control unit controls the stepping motor to maintain the step-out torque at which the half cutter cuts the main tape or the released tape by applying driving pulses at a cycle corresponding to width of the processed tape to the stepping motor.

5. The half-cut device according to claim 1, wherein the step-out torque is adjustable by applying drive pulses to the stepping motor at a cycle for producing a cutting load corresponding to a tape width of the processed tape.

6. A tape printer comprising:

the half-cut device according to claim 1; and a printing unit which performs printing for the processed tape fed to the half-cut device.

7. The tape printer according to claim 6, further comprising:

a full cutter which cuts the main tape and the released tape; and a power transmitting unit which transmits either a normal rotation force or a reverse rotation force of the stepping motor to the half cutter, and transmits the other of the normal rotation force and the reverse rotation force to the full cutter.

8. A control method for a stepping motor providing a power source for a half cutter cutting a main tape or a released tape of a processed tape which the released tape is affixed to the main tape, comprising:

controlling the stepping motor to cause the half cutter to contact the processed tape, and increasing upon contacting the processed tape, a cutting torque of the stepping motor until the cutting torque is stabilized at a step-out torque for the stepping motor, wherein the step-out torque at which the half cutter cuts the main tape or the released tape is maintained for a predetermined time.

9. The control method according to claim 8, further comprising controlling the stepping motor to maintain the step-out torque at which the half cutter cuts the main tape or the released tape for n ($10 \leq n \leq 5{,}000$) steps of driving pulses applied to the stepping motor.

10. The control method according to claim 8, further comprising controlling the stepping motor to maintain the step-out torque at which the half cutter cuts the main tape or the released tape for t ($0.1 \leq t \leq 2$) second(s).

11. The control method according to claim 8, further comprising controlling the stepping motor to maintain the step-out torque at which the half cutter cuts the main tape or the released tape by applying driving pulses at a cycle corresponding to width of the processed tape to the stepping motor.

* * * * *